United States Patent [19]

Martini

[11] Patent Number: 4,940,097

[45] Date of Patent: Jul. 10, 1990

[54] FLUID POWERED ROTARY PERCUSSION DRILL WITH FORMATION DISINTEGRATION INSERTS

[76] Inventor: Leo A. Martini, 2624 Montclair, Mesquite, Tex. 75150

[21] Appl. No.: 283,855

[22] Filed: Dec. 13, 1988

[51] Int. Cl.[5] ..... E21B 10/38; E21B 10/46

[52] U.S. Cl. ..... 175/296; 175/415; 175/417; 173/73; 173/78

[58] Field of Search ..... 175/65, 293, 296, 297, 175/414, 415, 417; 173/15-17, 73, 78, 80, 72, 135, 136, 138

[56] References Cited

U.S. PATENT DOCUMENTS

| | | |
|---|---|---|
| 1,892,517 | 12/1932 | Pennington . |
| 2,661,928 | 12/1953 | Topanelian, Jr. . |
| 2,667,144 | 1/1954 | Evans . |
| 2,774,334 | 12/1956 | Cline, Jr. . |
| 2,815,932 | 12/1957 | Wolfram . |
| 2,868,511 | 1/1959 | Barrett . |
| 2,942,578 | 6/1960 | Huffman . |
| 3,163,240 | 12/1964 | Bodine . |
| 3,193,024 | 7/1965 | Cleary . |
| 3,307,641 | 3/1967 | Wiggins, Jr. . |
| 3,327,790 | 6/1967 | Vincent et al. . |
| 3,387,671 | 6/1968 | Collier . |
| 3,403,739 | 10/1968 | Brown . |
| 3,410,353 | 11/1968 | Martini . |
| 3,464,505 | 9/1969 | Vincent et al. . |
| 3,583,501 | 6/1971 | Aalund . |
| 3,599,730 | 8/1971 | Tyreso . |
| 3,612,191 | 10/1971 | Martini . |
| 3,616,868 | 11/1971 | Bassinger . |
| 3,712,388 | 1/1973 | Curington . |
| 3,768,576 | 10/1973 | Martini . |
| 3,807,512 | 4/1974 | Pogonowski et al. . |
| 4,015,670 | 4/1977 | Rear . |
| 4,054,180 | 10/1977 | Bassinger . |
| 4,055,338 | 10/1977 | Dyer . |
| 4,257,245 | 3/1981 | Toelke et al. . |
| 4,303,138 | 1/1981 | Bassinger . |
| 4,312,412 | 1/1982 | Pillow . |
| 4,331,006 | 5/1982 | Bishop . |
| 4,502,552 | 3/1985 | Martini . |

*Primary Examiner*—Bruce M. Kisliuk
*Attorney, Agent, or Firm*—Michael A. O'Neil

[57] ABSTRACT

A novel fluid powered rotary percussion drill is disclosed having a small, efficient, fluid energy to impulsive mechanical energy conversion motor and a unique bit arrangement wherein individual independently acting formation disintegration inserts are periodically actuated by the motor at a comparatively high cycle frequency to drill earthen boreholes. Bit drilling structure is renewable by replacing individual inserts and better borehole diameter and bit cutting ability is maintained by rotational gage row inserts. Bottom borehole sensing structure determines drill operational mode.

13 Claims, 2 Drawing Sheets

FLUID POWERED ROTARY PERCUSSION DRILL WITH FORMATION DISINTEGRATION INSERTS

TECHNICAL FIELD

The present invention relates to improved fluid powered rotary percussion drills for producing mine and quarry blast holes, water wells, construction holes, oil and gas wells and the like wherever hard rock is encountered; and to provide better, longer lasting, more economical, and more efficient and effective equipment for drilling such boreholes.

BACKGROUND

A number of air driven percussion drilling tools are in use today which embody the hammer and anvil principle of converting fluid energy to mechanical energy for drilling purposes and are the accepted standard of the state of the art. Very few if any significant improvements have been made in recent years to advance the state of the art, so that all known equipment suppliers provide somewhat similar hammers and bits with minor differences. Examples of these tools are disclosed in U.S. Pat. No. 4,054,180 to Bassinger; U.S. Pat. No. 3,712,388 to Curington; U.S. Pat. No. 4,015,670 to Rear; and U.S. Pat. No. 3,768,576 by Martini.

The above-listed tools are comparatively large, have high stress levels at percussion, and have comparatively low cycle frequency. Because the mandrel-bit is massive, in order to achieve reasonable energy transfer from the piston, it must also be comparatively massive resulting in slower piston accelerations and tool cycle frequency for a given fluid energy supply. Also, the pistons are usually of less weight than the mandrel-bit resulting in instantaneous piston reversals at percussion leading to shock fatigue stresses and energy retension in the piston with wasted fluid pressure on the piston upstroke.

Also, when the cutting structure of the mandrel-bit becomes worn underside on the diametrical hole gage row of inserts or excessive flats are worn on the cutting tips of the inserts; or if the fixed non-replacable pressed in position inserts are broken, the whole large extendable splined mandrel-bit must be replaced as a unit incurring expensive replacement costs.

Other disadvantages include high drawdown forces that are required to keep the tool case closed with the mandrel-bit during operation, and tool length which may be a problem on some drilling rigs since the tool is installed under the rig rotary table. Another disadvantage on some drills is that no provision is made for air volume adjustment to provide suitable annulus air velocity for different bit sizes, while other drills require major disassembly and reassembly of the drill to make the necessary air volume adjustments.

SUMMARY OF THE INVENTION

The present invention provides new and useful improvements in the state of the art of fluid powered oscillatory piston percussion motors and associated percussion drill bits for drilling earth boreholes.

In accordance with the invention, a small, novel, efficient, linear fluid powered impulsive kinetic energy impact motor is rigidly coupled with an innovative drill bit having multiple independently mounted, extendable, suitable guided, retained, spaced and directed pin-like drilling bit inserts that are preferrably carbide tipped on the formation end and are adapted to be struck repeatedly by the piston of the close coupled motor on the opposite end. This drives the bit inserts forward to fracture the formation in continuous operation while the entire unit is rotated with the drill string. Fluid energy supplied through the drill string operates the self starting rectilinear oscillatory fluid motor which converts the fluid energy to mechanical impulse energy and is in turn furnished to the drill bit inserts as impulsive kinetic energy to achieve the comparatively high rock fracture forces required for the inserts to penetrate.

The new and unusual percussion drill bit configuration provides some distinct advantages in that the drilling structure can easily be renewed by replacing the bit inserts; better borehole diameter maintenance is provided by rotational outer gage diameter inserts; energy from the motor piston bypasses the bit body and is applied directly to the inserts and drilled medium; bottom hole sensing inserts located near the center of the bit control modes of tool operation; and bit wear resistant spacers are provided to further increase the life of the bit inserts, protect the bit body face and insure good borehole face fluid flush.

A borehole bottom sensing apparatus consists of formation feeler inserts of the bit that coact with the control valve and piston of the fluid motor to provide two modal motor operation. The first or active motor mode operation is the normal motor function on bottom borehole rotary drilling and the second or passive mode is non-operational high volume fluid passage used off-bottom for borehole flushing.

The simple, small, efficient fluid motor in the first operational mode with bit bottomhole contact and application of pressure fluid to the motor input runs automatically due to a fluid valving arrangement wherein the piston and control valve coact to alternately provide fluid pressure differentials on the opposing piston end surfaces for limited rectilinear oscillation of the piston and resulting impulsive motor output to the bit inserts for formation fracture.

A significient feature of the percussion drill bit is that each or all of the cutting structure inserts may be easily replaced thus renewing the drilling ability of the bit without replacing the bit body or other expensive components.

A decided advantage of a bit of the type described is that the inserts of most consequence are mounted for rotation on their axes which reduces flat producing scuffing and abrasion wear and permits more uniform wear around the peripheral surfaces providing insert tips that are comparatively long lasting and self sharpening.

Since the piston mass, which is about half that of similar diameter comparable percussion drills, is larger than the combined insert mass, little or no piston rebound will occur and the energy transfer to the inserts will be less instantaneous resulting in lower stress levels with less loss of fluid energy application to the piston on the upstroke. Another desirable feature of this percussion drill construction is that much lower drilling rig drawdown force is required since the piston chamber is substantially closed to areas that can provide external tool pressure extension forces as with other tools that have a reciprocal mandrel-bit. Another advantage is the cost effective bit cutting structure renewal method by insert changeout providing a simple convenient means for field repairing bits with minimal waste.

From the foregoing, it is apparent that this simple, small, efficient, high frequency fluid powered percussive kinetic impulse motor rigidly coupled for periodic direct energy transfer from said motor piston to renewable, individual, self sharpening, rotationally and reciprocally mounted cutting structure inserts constitutes a unique device for producing earth boreholes. Additionally, the novel bottom hole sensing means for motor and fluid control enhances and improves the state of the art. The automatic starting and running rectilinear motor with maximum piston areas, efficient upper piston reversal cushion, relatively short piston stroke, and effective on demand valving combine to provide an energy conversion and application structure of unusual practicality.

DESCRIPTION OF THE DRAWINGS

A more complete understanding of the invention and its advantages will be apparent from the following detailed description taken in conjunction with the accompanying drawings in which.

DETAILED DESCRIPTION

Figure 1:
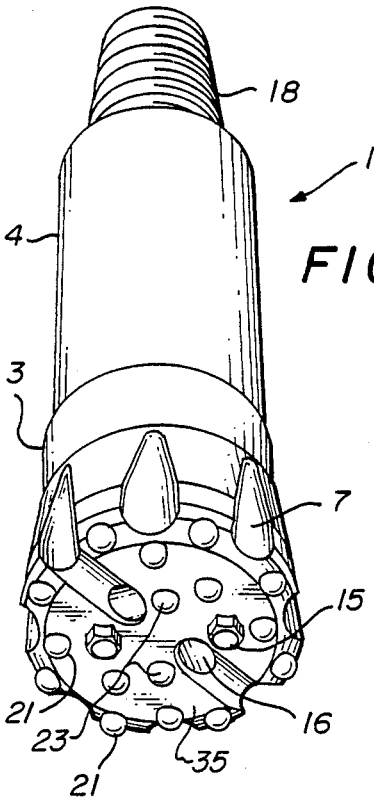
FIG. 1 is a perspective view of the percussion drill assembly.

Referring initially to FIG. 1, the percussion drill assembly 10 is shown in a raised position. The fluted outside diameter 7 of the bit body 3, the exhaust fluid passages 16 and the inserts 21, and 23 and drilling spacers 15 are seen below. The threaded connection 18 for a drill string is shown at the upper end of the drill motor housing 4.

Figure 3:
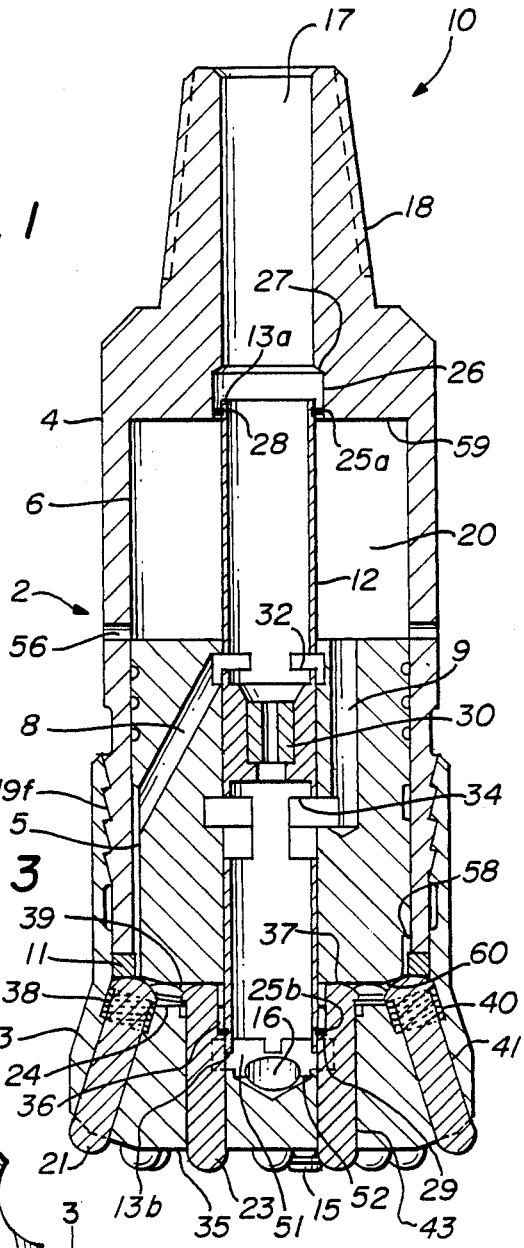
FIG. 3 is a vertical sectional view taken along lines 3—3 of FIG. 2 showing the longitudinal cross-section through the center of the percussion drill.
Figure 2:
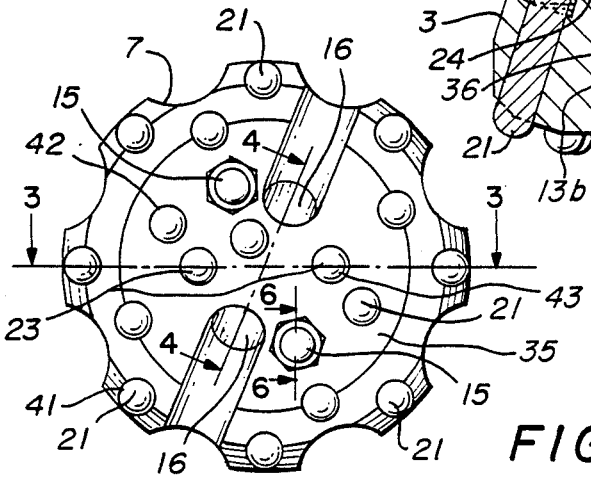
FIG. 2 is an upward looking end view of the bit face of the percussion drill as viewed normal to the longitudinal centerline.

Referring now to FIGS. 2 and 3, which are respectively a bottom view and a longitudinal section taken from FIG. 1, the percussion drill assembly 10 is seen to include a drill motor housing 4 and a drill bit body 3. The housing 4 has a hollow upper end 17 with threads 18 for engagement with a conventional drill string. The lower part of motor housing 4 is tubular and the inner diameter 6 fits freely on piston 5. Piston 5 is of an annular configuration, fitting freely over valve tube 12. Piston 5 is also ported with upward biasing fluid passage 8 and downward biasing fluid passage 9. The piston 5 is enclosed by drill bit body 3 which is attached to the lower part of motor housing 4 by means of threads **19*m* and 19*f*. An upper piston chamber 20 is thus defined by the inner diameter 6, the surface 59 of motor housing 4 and the top of piston 5. An opposed lower piston chamber 60 is defined by the inner diameter 6, the inner surface 24 of bit body 3, the bottom of piston 5 and the insert heads 37 and 39**.

Valve tube 12 has a fluid pressure orifice 30 in its central portion. Fluid is supplied through the hollow upper end 17 and is at a higher pressure above fluid pressure orifice 30 than it is below because of the pressure drop induced by the fluid flow. Valve tube 12 also has ports 34 and 32 below and above pressure orifice 30, these ports communicate with piston fluid passages 8 or 9 according to the position of valve tube 12 relative to the piston 5. The valve tube 12 has a square cut upper end **13*a* and a relieved cut lower end 13*b***.

The bottom surface of bit body 3 is drilling face 35 with bit spacers 15 fixed thereon. Bit body 3 also has a plurality of insert guide holes 42 which may be either parallel to the vertical centerline of the percussion drill assembly 10 or inclined radially outward. An added set of gage diameter insert guide holes 41 are spaced around the outer periphery of drilling face 35. Also, a set of bottom hole sensing insert guide holes 43 are parallel to the vertical centerline and located so that they are approximately tangent to the outer surface of valve tube 12. These insert guide holes 41, 42 and 43 all pass through the bit body 3 to the inner surface 24. The holes 41 have counterbores 40 for insert springs 38. Drilling inserts 21 have cylindrical body 31 with an enlarged rounded head 39 and extend through insert guide holes 41 and 42 in a close fitting, sliding relationship for reciprocal and rotary motion. Bit sizing ring 11 limits the downward stroke of piston 5 by engagement with step 58 on said piston. Bit sizing ring 11 also limits retracted position of inserts 21 in the gage diameter holes 41 against springs 38, thus controlling bore size. Bottom-hole sensing inserts 23 are similar in shape to drilling inserts 21, having a cylindrical body with the addition of a concave cylindrical relief surface 36 which is inset on one side and passes continuously through the enlarged rounded head 37, ending in step 29. Inserts 23 extend through insert guide holes 43 in a close fitting, sliding relationship permitting reciprocal but not rotary motion. The bottom-hole sensing inserts 23 perform the dual function of sensing and drilling.

Thin multiple annular split springs serve as seal rings **25*a* and 25*b*, mounted in seal grooves 28 near the upper and lower ends respectively of valve tube 12. The seal ring 25*a* contacts sealing diameter 26 in housing 4. Seal ring 25*b* contacts surfaces 36 of bottom-hole sensing inserts 23 as well as the counterbored surface 50 to inner bit surface 24. The lower seal ring 25*b* is contacted by step 29 in the limiting relative positions of valve tube 12 and insert 23**.

Figure 4:
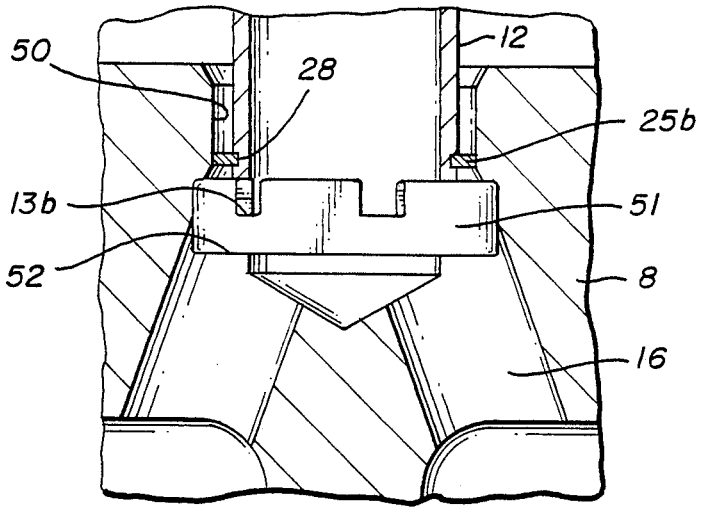
FIG. 4 is a partial cross-sectional view of the lower central portion of the percussion drill taken along lines 4—4 of FIG. 2 showing air passages through the bit center.

FIG. 4 shows the counterbored surface 50 extending into cavity 51 which communicates with fluid passages 16, thus providing a fluid outlet from the percussion drill assembly 10. The bottom surface 52 of cavity 51 acts as a stop for downward travel of valve tube 12 by contact with said lower relieved cut end **13*b***.

Figure 5A:
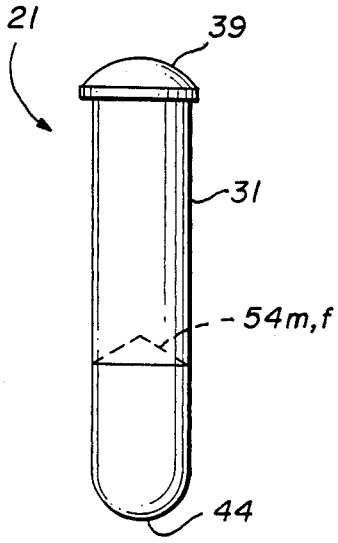
FIG. 5A and 5B show shows two preferred bit insert configurations.
Figure 5B:
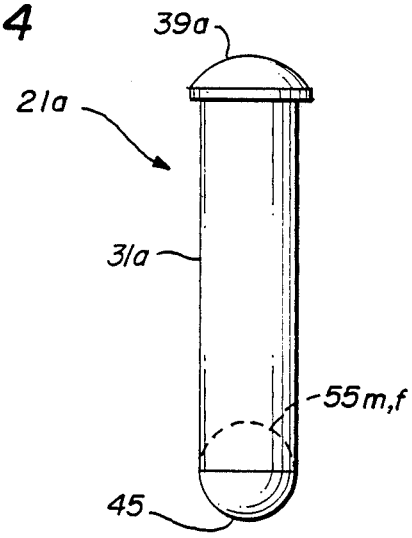

FIGS. **5*a* and 5*b* show alternate forms of tungsten carbide or similar hard materials for incorporation into drilling insert 21 or 21*a* as well as inserts 23 on the top. In FIG. 5*a* the carbide tip takes the form of a modified cylinder having the same diameter 31 as drilling insert 21 and 23. The penetrating tip 44 is preferably of a spherical shape as is shown, however it may also be a modified conical form. The opposite end of the carbide tip 54*m* is formed as a truncated conical section, mating with an inverted conical end 54*f* which provides structural support for the brazed connection. In FIG. 5*b* the carbide tip takes the form of a sphere 45 and is mated with the concave spherical end 55** which provides structural support for its brazed connection thereto.

Figure 6:
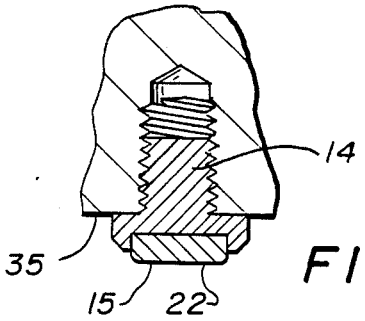
FIG. 6 is a cross-sectional view taken along line 6—6 of FIG. 2 showing details of a bit spacer and is shown rotated 90° clockwise.

FIG. 6 shows the manner of attachment of bit spacer 15 to drilling face 35 by threaded fastener 14 having a brazed-in hard metal wear resistant wafer 22.

OPERATION OF THE INVENTION

The valve tube 12 has a pressure differential across the central orifice 30. The upper tube portion conducts high pressure fluid from housing bore 17 to ports 32 and the lower tube portion conducts a lower pressure fluid from ports 34 and to the bit passages 16. The valve tube 12 has two positions, a first position for normal continuous drilling on bottom borehole operation of the motor, which is the up position as shown in FIG. 3, and a second down position in which fluid motor operation is prevented and a high volume of fluid is allowed to pass through the motor and bit passages. The first or second position of valve tube 12 is determined by coacting sensing inserts 23 which, if pushed upwardly, as when contacting the borehole bottom, raise the valve tube 12 into the first position and cause the motor to cycle. If the sensing inserts are extended, the valve tube is allowed to shift into the lower second position and motor operation ceases.

This motor operation control is accomplished by the piston 5 and valve tube 12 porting. When the valve tube 12 is in the first, raised position and the piston 5 is down, high pressure fluid is admitted to the lower piston chamber 60 through ports 32 and fluid passage 8 while the upper piston chamber 20 is vented to the reduced pressure below the central orifice 30. This causes the piston to move toward the top of upper piston chamber 20. As the piston 5 moves toward the top of the chamber 20, passage 9 passes port 32 charging chamber 20, trapped fluid is compressed, the piston slows and reverses, and fluid passage 9 again comes into alignment with port 32. This admits high pressure fluid to the upper piston chamber 20 while, at the same time, the bottom of piston 5 has cleared port 34 to vent the residual fluid pressure in the lower piston chamber 60. Piston 5 is thus driven down to the starting position where it impacts against the drilling insert heads 37 and 39 and aligns port 32 and fluid passage 8 to repeat the cycle in a continuing reciprocation.

In the normal drilling operational mode the arrangement of ports, and fluid passages in the valve tube 12 and the coacting piston 5 is such that alternate charging and discharging of upper and lower piston chambers causes continuous piston reciprocation and periodic mass-velocity related kinetic energy transfer to the inserts for formation disintegration. The motor piston cycle is repetitive at relatively high frequency as the percussion drill is rotated so that the inserts are impulsively driven into the rock formation every few degrees of bit rotation.

Housing side ports 56 are optional but may be used to insure that fluid pressure driving the piston drops to a sufficiently low pressure near the end of each piston up and down stroke. Said ports are normally sealed during most of the piston stroke and are only open for fluid communication there through from the chamber 20 above piston 5 and chamber 60 below piston 5 to the outside of the drill only after fluid exhaust porting from said chambers has taken place through the piston 5 valve tube 12 porting arrangement near the end of each piston stroke.

As previously indicated the valve tube 12 has two positions, a first position for fluid motor operation and a second position that prevents motor operation and also allows the percussion drill to pass a large volume of fluid for borehole flushing. The above two positions are determined by sensing inserts 23 in coaction with the valve tube 12. The pressure differential acting across the valve tube from the high pressure upper end to the lower pressure lower end tends to force the valve tube downward while any upward force on sensing inserts 23 will counteract the pressure induced downward force of the valve tube 12. Since the valve tube seal ring **25*b* comes into engagement with step surface 29 of the sensing inserts, it will be understood that if the inserts extend, the control valve goes to its second position and the drill is off bottom borehole in the non-operational borehole flushing mode, and if the inserts are pushed up as if the drill is against the bottom of the borehole, the valve tube 12 is in a first position motor operational mode. One or more sensing inserts 23 may be used and any or all may support the first control valve position by pushing up on seal ring 25*b*. When the sensing inserts are allowed to extend as would be the case if the percussion drill is lifted off the borehole bottom, the control valve is caused to shift down until the lower relieved end 13*b* of valve tube 12 engages internal bit surface 52 and seal rings 25*a* and 25*b* shift out of their respective sealing bores 26 and 50 allowing substantially large volumes of fluid to pass, equalizing pressures above and below piston 5. The valve tube 12 and piston 5 porting relationship retains the initial cycle start piston location because of the relatively short valve tube 12 shift distance. Fluid can now pass freely between upper seal rings 25*a* and bore 26 into the upper piston chamber 20, through piston passageway 9 and valve tube ports 34 into the lower end of the valve tube 12, through the valve tube relieved end 13*b* and into passages 16. Also fluid can pass freely from the upper high pressure end of the valve tube 12 through valve tube 12 ports 32 through piston 5 passageway 8 into lower piston chamber 60 and on through the now open spacing between lower seal ring 25*b* and internal counterbore surface 50 into cavity 51 and on through passages 16** for flushing the borehole.

Bit spacer 15 as shown in FIGS. 1, 2 and 6 has an outer periphery for wrenching the attachment screw threaded fastener 14 in position on face surface 35. The bit spacer is readily renewable by replacement on the job site along with the drilling and sensing inserts 21 and 23.

Bit sizing ring 11 locates outer peripheral inserts 21 and is positioned between the lower end surface of housing 4 and a portion of internal bit surface 24 and extends upwardly a short distance to limit the extreme downward movement of piston 5 by engagement with the step 58 on the outside diameter of piston 5. This is necessitated because in the transition from first mode operation to second mode operation one or more impacts may occur and protection is thus provided for bit components. Sizing ring 11 may also be used to adjust the bit gage diameter by variation of its thickness.

I claim:

1. A fluid powered rotary percussion drill for drilling earth bore holes with a conventional drill string comprising:

a percussion drill motor housing, the upper end thereof being hollow to pass fluid flow and adapted for threaded connection to said conventional rotary drill string;

a piston having upper and lower ends internally fitted to said drill motor housing for vertical reciprocating motion therein between upper and lower limits;

valving means passing through said piston for alternately directing fluid pressure admitted through said hollow upper end of said drill motor housing to said upper and lower piston ends thereby affecting said vertical reciprocating motion and for enabling the movement of said piston from a first position allowing for continuous piston oscillation to a second position disabling piston oscillation and permitting voluminous fluid flow through the drill;

a percussion drill bit body having an upper section adapted for threaded connection to the lower end of said motor housing and a lower section including a downwardly oriented drilling face;

a plurality of vertical and inclined inserts guide holes passing through said drill bit in a spaced pattern; and a substantially cylindrical insert having first and second send fitted in each said insert guide hole for longitudinal movement therewith wherein said first end is adapted for contact with said lower end of said piston and said second end is adapted for percussive contact with the bottom of said earth bore and wherein one or more of said plurality of inserts contacts said valving means when said insert is placed longitudinally, thereby shifting said piston from its second non-oscillation position to its first oscillation position.

2. A fluid powered drill according to claim 1, wherein said valving means comprises:

a cylindrical central bore in said piston;

a central cylindrical valve tube extending from a level significantly above the upper limit of vertical reciprocating motion of said piston to a level significantly below the lower limit of reciprocating motion of said piston, said valve tube being adapted for a close sliding fit within said cylindrical central bore of said piston;

a first set of one or more internal fluid passages in said piston, said passages communicating with the upper surface of said piston from a first opening into said cylindrical central bore at a level substantially below said upper surface;

a second set of one or more internal fluid passages in said piston, said passages communicating with the lower surface of said piston from a second opening into said cylindrical central bore, said second opening being substantially above said first opening;

a fluid pressure reducing orifice interposed in the length of said valve tube passing through said piston whereby pressurized fluid flow through said valve tube will have a lower pressure downstream of said orifice;

one or more first ports in said valve tube located at a level below said pressure reducing orifice, said first port communicating with said first opening when said piston approaches the lower limit of its vertical reciprocating motion; and, one or more second ports in said valve tube located at a level above said pressure reducing orifice, said second ports communicating with said second opening when said piston approaches the lower limit of its vertical reciprocating motion and with said first opening when said piston approaches the upper limit of its vertical reciprocating motion.

3. A fluid powered drill according to claim 1, wherein said drill motor housing is fixed relative to said drill bit body.

4. A fluid powered drill according to claim 3, wherein said drill bit body further comprises:

spacer means for spacing said downwardly oriented drilling face from the bottom of said borehole during drilling.

5. A fluid powered drill according to claim 4, wherein said spacer means comprise one or more flattened carbide elements attached to said downwardly oriented drilling face.

6. A fluid powered drill according to claim 1, wherein a portion of said plurality of inclined insert guide holes is spaced around the periphery of said downwardly oriented drilling face; and, each said peripheral guide hole being fitted with one said substantially cylindrical insert.

7. A fluid powered drill according to claim 6, with means for cutting borehole gage, comprising:

a spacer ring of selectable thickness fixedly mounted in aforesaid bit body so as to set an upward limit on aforesaid longitudinal movement of said inserts fitted in said peripheral guide holes; and, a compression spring urging each said insert towards contact with said spacer ring.

8. A fluid powered drill according to claim 7, wherein said inserts are free to rotate in said peripheral insert guide holes.

9. A fluid powered rotary percussion drill for drilling earth bore holes with a conventional drill string comprising:

a motor housing, the upper end thereof being hollow and adapted for threaded connection to said conventional drill string;

a piston for generating kinetic energy impulses, said piston having upper and lower ends internally fitted to said motor housing for vertical reciprocating motion therein;

valving means passing through said piston for alternately directing fluid pressure admitted through said hollow upper end of said motor housing to said upper and lower piston ends thereby effecting vertically reciprocating motion thereof and for enabling the movement of said piston from a first position allowing for continuous piston oscillation to a second position disabling piston oscillation and permitting voluminous fluid flow through the drill;

a drill bit characterized by a downwardly oriented drilling face fixedly attached to said motor;

a plurality of vertical and inclined inserts guide holes passing through said drill bit in a spaced pattern; and a substantially cylindrical insert having first and second ends fitted in each said insert guide hole for longitudinal movement therewith wherein said first end is adapted for contact with said lower end of said piston and said second end is adapted for percussive contact with the bottom of said earth bore hole and wherein one or more of said plurality of inserts contacts said valving means when said insert is placed longitudinally, thereby shifting said piston from its second non-oscillation position to its first oscillation position.

10. A fluid powered drill according to claim 9 wherein said bit is renewable by replacing said individual inserts.

11. A fluid powered drill according to claim 9, wherein a portion of said plurality of said reciprocating individually guided inserts is spaced around the periphery of said downwardly oriented drilling face, each said peripheral insert being inclined radially outward at a substantially similar angle.

12. A fluid powered drill according to claim 11, with means for cutting borehole gage, comprising:

a spacer ring of selectable thickness fixedly mounted in aforesaid drill bit so as to set an upward limit on aforesaid reciprocating movement of said inserts; and, a compression spring urging each said insert towards contact with said spacer ring.

13. A fluid powered drill according to claim 12, wherein said inserts are free for both rotary and reciprocal motion.

* * * * *